US005221030A

United States Patent [19]

Cretinon

[11] Patent Number: 5,221,030

[45] Date of Patent: Jun. 22, 1993

[54] ELONGATED BAG

[75] Inventor: Frederic Cretinon, Sevrier, France

[73] Assignee: Salomon S.A., Chavanod, France

[21] Appl. No.: 618,235

[22] Filed: Nov. 21, 1990

[30] Foreign Application Priority Data

Nov. 22, 1989 [FR] France ..... 89 15322

[51] Int. Cl.[5] ..... A45F 3/02

[52] U.S. Cl. ..... 224/202; 224/907; 206/315.3; 273/32 E

[58] Field of Search ..... 224/202, 218, 907; 206/315.3, 315.7, 315.8; 273/32 E; 150/107, 110; 24/601.2, 601.4, 600.9

[56] References Cited

U.S. PATENT DOCUMENTS

| | | | |
|---|---|---|---|
| 693,432 | 2/1901 | Owen | 224/202 X |
| 1,741,057 | 12/1929 | Howe | 206/315.8 |
| 2,186,491 | 1/1940 | Meyer | 206/315.7 |
| 2,364,223 | 12/1944 | Keim | 206/315.3 |
| 3,432,130 | 3/1969 | Breedlove et al. | 206/315.7 X |
| 4,767,001 | 8/1988 | Kim | 206/315.3 |

FOREIGN PATENT DOCUMENTS

| | | | |
|---|---|---|---|
| 3431310 | 7/1985 | Fed. Rep. of Germany | 24/601.2 |

*Primary Examiner*—Henry J. Recla
*Assistant Examiner*—Glen T. Barrett
*Attorney, Agent, or Firm*—Pollock, Vande Sande & Priddy

[57] ABSTRACT

Elongated bag, especially for golf clubs, of the type incorporating a carrying strap whose upper and lower ends are fastened to the bag (1) at upper (6) and lower (5) points of attachment, respectively. This bag comprises, above the upper point of attachment (6) of the strap (4), a support arrangement (7) for the forearm of the user of the bag when the strap is in place on the shoulder, this support arrangement (7) comprising an abutment portion (8) unitary with the wall of the bag (1) and a part (9, 12', 17) projecting outward from this abutment portion (8), the abutment portion (8) and the projecting piece (9, 12, 17) forming a support groove in which the forearm of the wearer of the bag may be placed.

18 Claims, 4 Drawing Sheets

ELONGATED BAG

FIELD OF THE INVENTION

The present invention relates to an elongated bag, especially for golf clubs and carried by means of a shoulder strap.

BACKGROUND OF THE INVENTION

It is well known that golf bags are used, first, to carry clubs over the golf course, hence requiring access which facilitates the choice of the right club, and second, for transport outside of the course, a function implying complete club protection. Furthermore, bags normally incorporate compartments for balls and other accessories.

Although transport outside the course does not require a particular position, since the entire unit is well closed, transport over the course requires that the bag be open and thus, that it be carried at a sufficient angle, its opening pointed upward and forward to prevent the clubs from accidentally falling out and to allow the clubs to be selected and returned to the bag with ease. For this reason, these bags have a strap or shoulder strap attached, first, near the opening at an upper fastening point, and second, approximately at the middle of the bag at a lower fastening point. The attachment of this shoulder strap is achieved using any sufficient means (buckles, spring snaps, etc.). The strap or shoulder strap is placed on the wearer's shoulder, the opening from which the heads of the clubs protrude being positioned toward the area in front of the wearer. The bag slopes by itself, so that the center of gravity is located approximately on the vertical of the support point on the shoulder. It has been observed that wearers of these bags have a natural tendency to rest the forearm corresponding to the supporting shoulder on the top part of the load, i.e., on the club heads or the parts of the shafts nearest the club heads. This position relieves the arm, blocks the bag to some extent, and, in consequence, reduces the risk that the shoulder strap will slip off the shoulder. It is evident, however, that the forearm resting on these club shafts does not lie in a very comfortable resting position.

The idea may occur to shift the upper attachment of the strap and move it away from the top part of the bag, so as to leave this area free to receive the forearm. This solution can be implemented only with difficulty, since shifting the attachment toward the center of gravity, as well as the forearm support stress, increase the tendency of the unit to tip over, with the attendant risk that the clubs will slide forward out of the bag.

Despite the disadvantage thus described, prior art has described the golf bags on which the upper attachment of the strap lies at a certain distance from the upper opening, without specifically mentioning that the area thus cleared may serve as a support for the forearm.

Patent No. GB-A-400350 discloses a bag for golf clubs having two parts jointed along a common generating line making it possible to fold the bag back in one direction, thus enclosing the clubs for transport outside the course, or in the opposite direction, thus extending the clubs outward for transport on the course. The strap may be mounted on one side or the other and, according to the drawings, at a certain distance from the top part. The possibility for imbalance is here made evident by the fact that the handle, provided in particular for transport off the course and which thus pinpoints approximately the center of gravity in the vertical dimension, is positioned in the immediate vicinity of the upper attachment of the strap. It then becomes evident that the weight of the forearm could easily unbalance the unit, thus giving rise to the above-mentioned disadvantage.

Very similar arrangements of the handle and upper attachment of the strap are disclosed in U.S. Pat. Nos. 1,849,610, 4,091,977, 2,091,298, and 1,696,062. According to other patents, when the bag is closed, the upper attachment of the strap lies at a distance from the top part, but is positioned at the edge of the opening when the bag is open and the part forming the cover is disassembled or shifted. This is the case with to the bags described in U.S. Pat. No. 4,767,001 and Japanese Published Applications Nos. 59-85680 and 56-36973.

SUMMARY OF THE INVENTION

It is an object of the present invention to delimit an ideal area of support for the forearm, which ensures both comfort for said arm and proper balance for the entire unit.

Another object of the present invention is thus to create a zone of support for the forearm, without changing weight distribution and the balance of the unit as determined by the geometry of the bag, its contents, and the support (shoulder) strap.

Accordingly, the object of the present invention is an elongated bag, especially for golf clubs, having a carrying strap whose upper and lower ends are attached to the bag at upper and lower points of attachment, respectively, the bag comprising, above the upper point of attachment of the strap, a support device for the forearm of the wearer of the bag when the strap is placed on the shoulder, this support device comprising at least one abutment portion unitary with the wall of the bag and one part projecting outward from this abutment portion, the abutment portion and the projection forming a support groove in which the forearm of the wearer of the bag may be placed.

According to one embodiment of the invention, the projection of the support device may form one piece with the abutment portion, this piece being made of molded plastic. The support device comprising the abutment portion and the projection may be formed from a separate block attached to the upper part of the bag; or it may form a single piece with the border fitted over the bag opening.

According to another embodiment, the projecting piece may be jointed on the abutment portion in such a way that it can be folded down substantially in the plane of this abutment portion when the bag is carried by the strap.

BRIEF DESCRIPTION OF THE DRAWINGS

Various embodiments of the present invention will be described below by way of example, with reference to the attached drawings.

DESCRIPTION OF THE PREFERRED EMBODIMENTS

Figure 1:
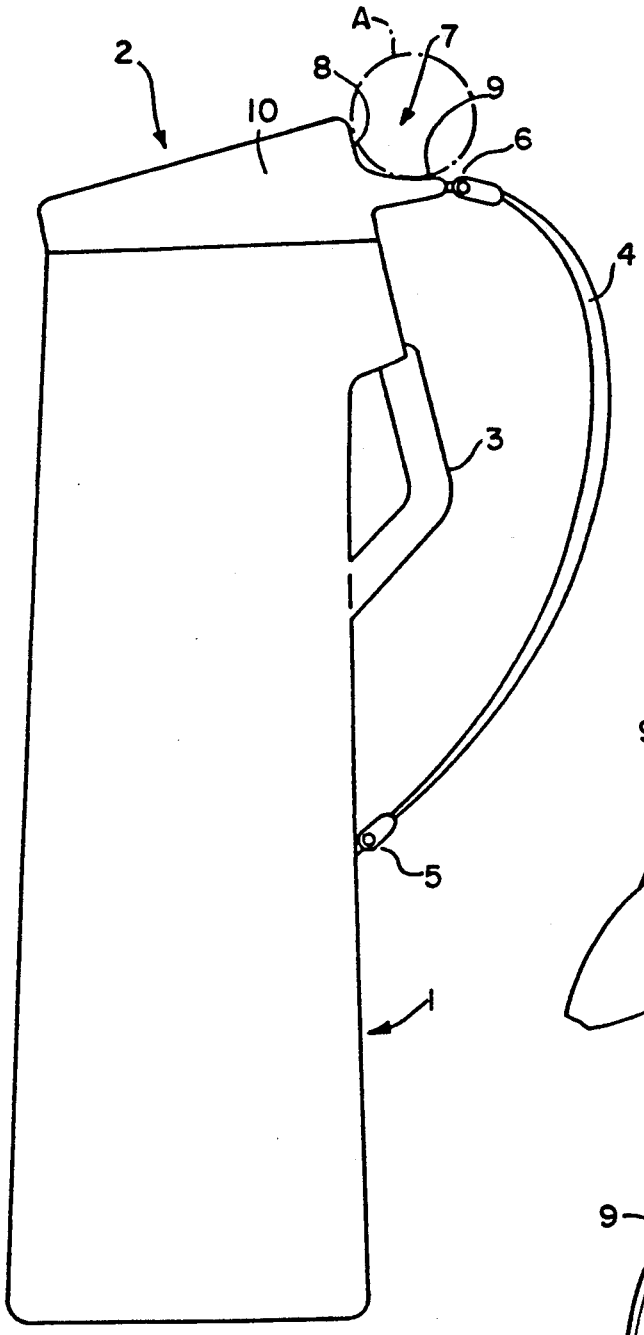
FIG. 1 is a side elevation view of a golf bag according to the invention.

FIG. 1 illustrates a golf bag 1 which incorporates, at its upper part, an opening 2 through which golf clubs (not shown) are inserted and removed. This opening 2 is closed by a cover when being carried outside the course. This cover (not shown) is of any conventional type. A handle 3 may be provided for the purpose of carrying the closed bag. When in use on the course, the bag is carried using a shoulder strap 4 attached to the lower part of the bag 1 at a lower point of attachment 5 and to the top part of the bag 1 at an upper point of attachment 6, using any adequate means (spring snaps, buckles, rings, transverse bars, etc.). In a conventional arrangement, the handle 3 and the strap 4 are located in substantially the same longitudinal and vertical plane. It will be noted that if the handle 3 lies at a level adjoining the center of gravity of the loaded bag, the lower point of attachment 5 of the strap 4 is at a much lower level, as in conventional arrangements.

According to the invention, the upper part of golf bag 1 is fitted with a device 7 provided to allow the support of the forearm A of the wearer of the bag, shown schematically by a chain-dotted line in FIG. 1 when the bag is worn on the shoulder, the strap 4 then passing over this shoulder. This support device 7 is constituted essentially by an abutment portion 8 attached to the bag in substantially the vertical, longitudinal plane containing the handle 3 and the strap 4, and by a stationary part 9 projecting outward from the bag, this projecting part 9 forming a single molded piece with the abutment portion 8, or else being assembled onto this abutment portion. The recessed portion 8 and projecting part 9 thus form a kind of angular groove, either rounded or forming a dihedral, so as to be better adapted to the anatomy of the forearm A which is placed in this groove.

In the embodiment shown in FIG. 1, the device 7 supporting the forearm A is unitary with a band 10 constituting a border surrounding the bag opening, the band 10 and the support device 7 being advantageously made of a light alloy or of a molded plastic material. The support device 7 may form one molded piece with the band 10, or it may be a separate piece fastened to the band 10.

The upper point of attachment 6 of the strap 4 is connected to the end of the projecting piece 9 by any adequate means, such as a transverse metal bar 11 connected to the projecting piece 9 (for example, the ends of the bar being embedded in the plastic material or light alloy forming the projecting piece 9 or the light alloy). The strap 4 is hooked onto the bar 11 by means of a spring snap whose width substantially matches the free length of the bar, thus preventing the strap from twisting.

Figure 2:
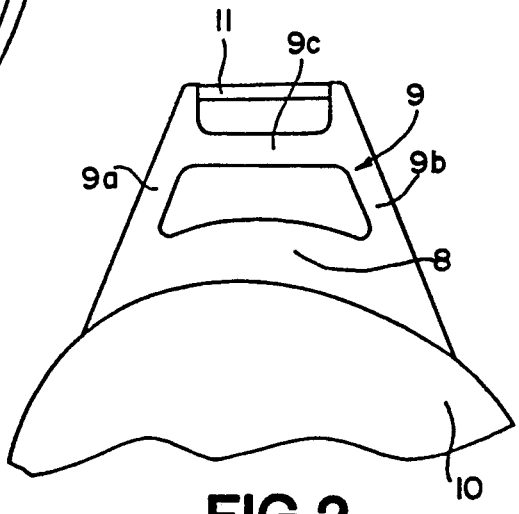
FIG. 2 is a plan view of the support device illustrated in FIG. 1.
Figure 3:
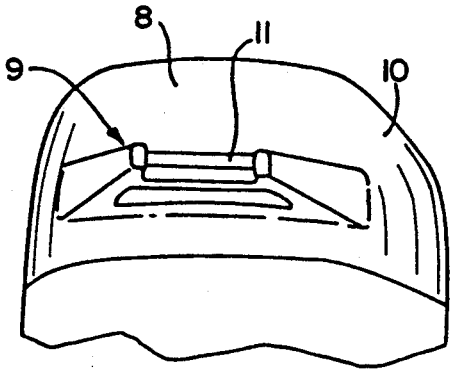
FIG. 3 is a perspective view of the support device illustrated in FIG. 1.

As can be seen more clearly in FIGS. 2 and 3, the projecting piece 9 of the support device 7 has, advantageously, when seen in plan view, the shape of an isosceles trapezoid having two converging lateral arms 9*a*, 9*b* emanating from the abutment portion 8, between the ends of which the metal bar 11 extends and which are connected, at a distance from this metal bar 11, by a crosspiece 9*c* parallel to this bar.

Figure 4:
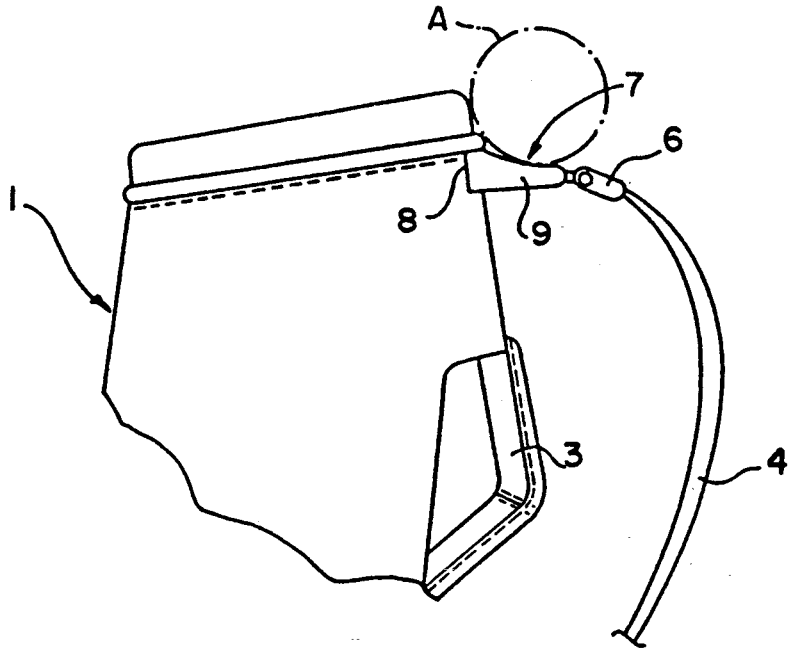
FIG. 4 is an elevation view of the upper part of a golf bag fitted with an embodiment of the support device according to the invention.
Figure 5:
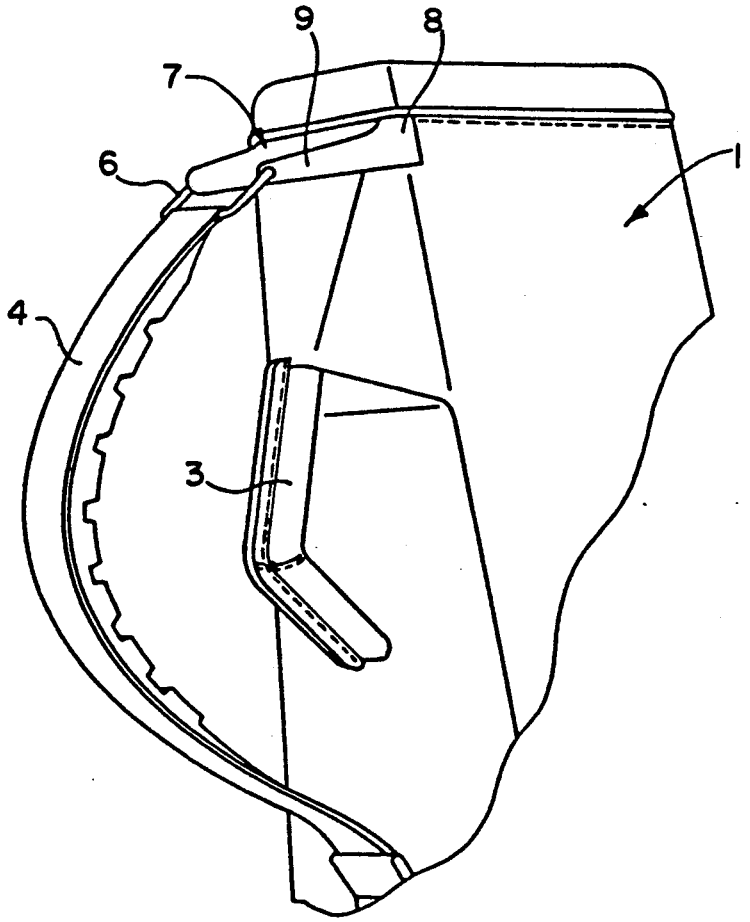
FIG. 5 is a perspective view of the upper part of the golf bag illustrated in FIG. 4.

In the embodiment shown in FIGS. 4 and 5, the support device 7 is constituted by a separate piece attached to the upper part of the bag by its abutment portion 8, which is shallow. The projecting piece 9 has, advantageously, an upper curved surface whose concavity is turned upward, so as to better mold to the shape of the forearm A.

Figure 6:
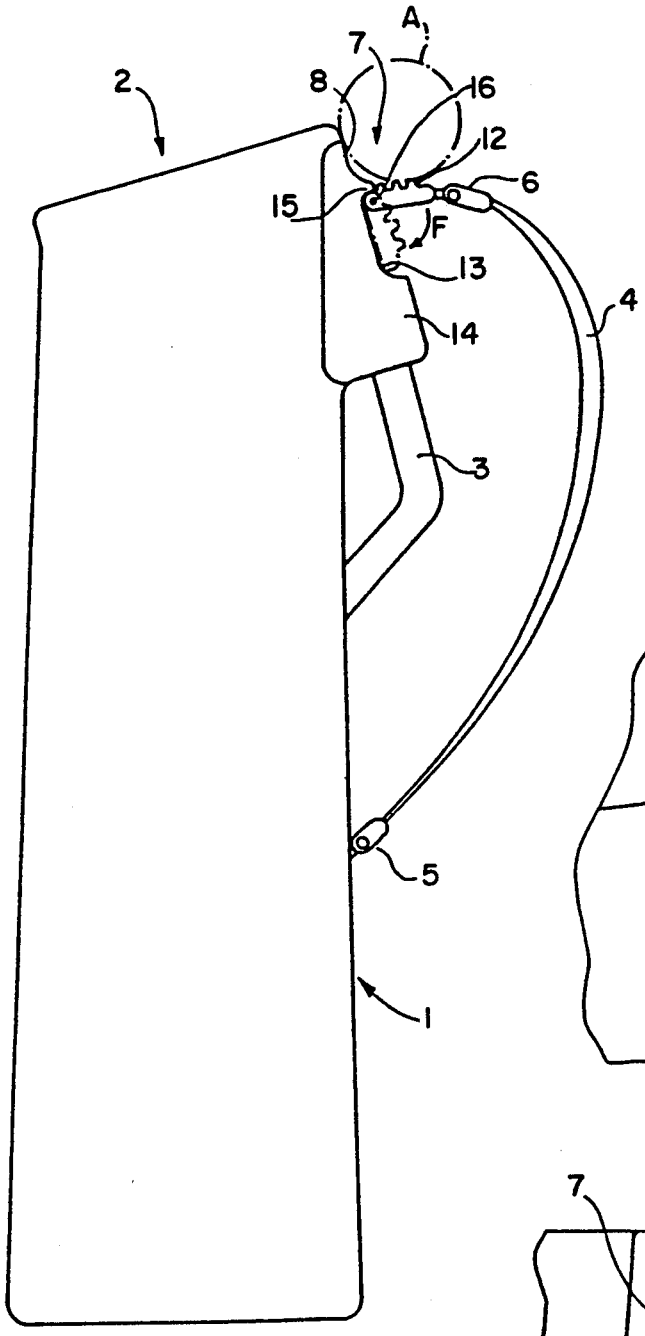
FIG. 6 is a side elevation view of a second embodiment of the bag according to the invention.
Figure 7:
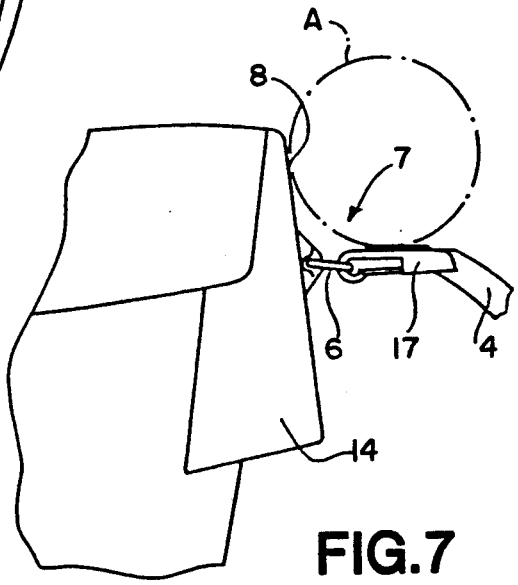
FIG. 7 is an elevation view of the upper part of a golf bag fitted with another embodiment of the support device.
Figure 8:
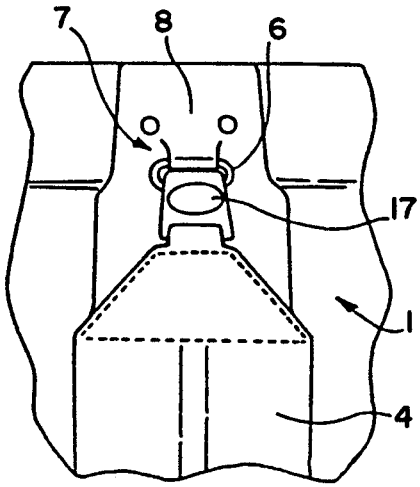
FIG. 8 is an elevation view of the support device in FIG. 7, as seen in a plane perpendicular to the plane of FIG. 7.

FIG. 6 shows an embodiment of the golf bag in which the support device 7 is composed of a molded abutment portion 8 fastened to the upper part of the bag and by a part 12 which is mounted so as to move between a projecting work position (indicated by a solid line in FIG. 6) and a retracted position in which it is folded down in the direction of arrow F into a recess 13, indicated by a chain-dotted line. The recess 13 is formed in the outer surface of a molded piece 14 attached to the bag and whose upper end piece forms the abutment portion 8 of the support device 7. This upper abutment portion 8 is separated from the recess 13 by a projection 15. The movable part 12 of the support device 7 is jointed by its upper end around a pin 16 positioned beneath the projection 15 and extending across the upper portion of the recess 13. This movable part 12 may be returned to the resting position in the recess 13 by a return spring (not shown in FIG. 6). At its upper point of attachment 6, the strap 4 is fastened to the movable end of the part 12, as it is to the projection 9 in FIG. 1; here, however, the traction exerted by the strap 4 and the weight of the bag 1 place this movable part in the working position in which it extends substantially perpendicular to the bag 1.

The upper, or exterior, surface of the movable part 12 is shown to be notched in FIG. 6. It may be of any shape suitable to receive the forearm, but may also be made non-slippery by using a non-smooth surface or a non-skid, preferably elastic, covering. This is also true for the stationary support grooves, as illustrated in FIGS. 1 to 5.

According to one advantageous embodiment, the carrying handle 3 may be made of a rigid plastic material and may form one piece with the molded piece 14 attached to the bag, by forming a downward extension of this latter.

In the embodiment shown in FIGS. 7 to 10, the strap 4 is connected to its upper point of attachment 6 which, in this case, is constituted by a ring, by means of a flat fastening hook 17 fastened to the ring 6, which is jointed to the molded piece 14 using any suitable means. This flat fastening hook 17, which normally hangs freely along the lower part of the exterior surface of the molded piece 14 when the bag is in the vertical position, is made to pivot and to be pulled into a position substantially perpendicular to this surface when the bag is carried by the strap 4 placed over the shoulder. In this position, illustrated in FIGS. 7 and 8, the fastening hook forms a projection which, together with the abutment portion 8, delimits the support device 7 for the forearm A.

Figure 9:
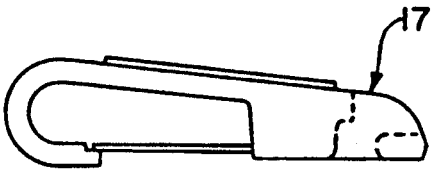
FIG. 9 is an elevation view on an enlarged scale of the hinged fastening hook associated with the support device shown in FIGS. 7 and 8.
Figure 10:
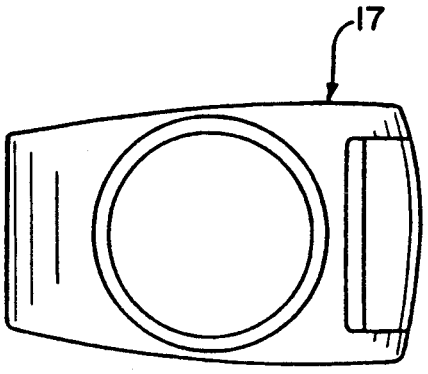
FIG. 10 is a plan view of the hinged fastening hook illustrated in FIG. 9.

The fastening hook 17, which be may rectangular or substantially trapezoidal, as can be better seen in FIGS. 9 and 10, must be wide enough to provide comfortable support for the forearm. This width is at least 1 cm, and preferably between 3 and 4 cm. This fastening hook 17 forms a spring snap which may be attached to its upper point of attachment either directly or by an intermediate ring, as described above.

In all of the embodiments previously described, the abutment portion 8 of the support device 7 which extends along the upper edge of the bag may have an exterior surface parallel to this edge or inclined in relation to it.

Figure 11:
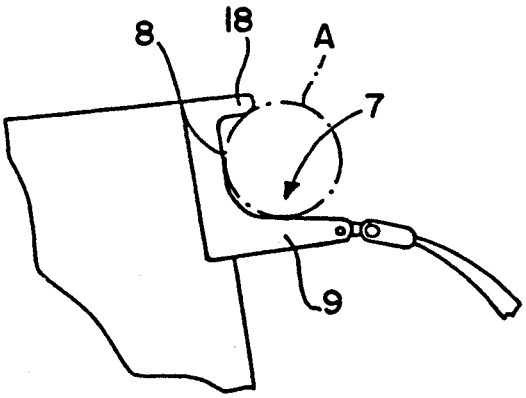
FIGS. 11 and 12 are partial elevation views of other embodiments of the support device.
Figure 12:
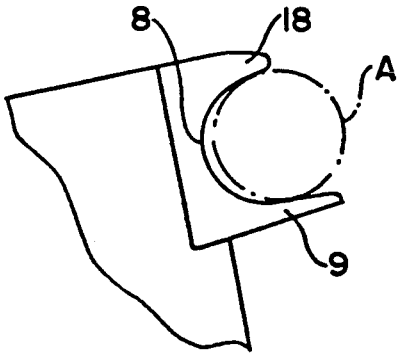

According to the embodiment shown in FIG. 11, a stop 18 may be provided at the upper end of the abutment portion 8 of the support device 7. The projecting part 9, the abutment portion 8, and the upper stop 18 may be of any appropriate shape optimally adapted to the morphology of the forearm A. For example, as illustrated in FIG. 12, the surfaces of the projecting piece 9, of the abutment portion 8 and of the stop 18 are connected to each other so as to delimit a recess having a curved vertical section molded to the curvature of the forearm A.

It will also be noted that the various parts of the bag according to the invention may be covered, for example with leather, fabric, or imitation leathers or fabrics, as is conventional practice when making golf bags. Furthermore, while simple bags have been illustrated in the drawings, it is evident that the invention applies equally in cases in which the bags have different shapes resulting principally from the addition of pockets or receptacles for balls and other accessories. It is also evident that the invention applies to any elongated bag used for other contents, such as fishing rods, mailing tubes, musical instruments, etc.

What is claimed is:

1. Elongated bag, especially for use with golf clubs, having a shoulder carrying strap including upper and lower ends said ends being connected to said bag at upper and lower points of attachment respectively said elongated bag further comprising an arrangement adapted for supporting a forearm of a user of said bag when said strap is placed in a carrying position on a shoulder, said arrangement being located on said bas at a point above said upper point of attachment and comprising a substantially planar abutment portion unitary with a wall of said bas and positioned above said upper point of attachment and a substantially planar part projecting substantially perpendicularly from said abutment portion, said projecting part being jointed, about a hinge pin, on a molded piece fastened to said bag and having an upper end part located above said hinge pine whereby, said abutment portion and said upper end part of said projecting part form a support trough for a forearm of the user of said bag.

2. Bag according to claim 1, wherein said upper point of attachment of said strap is located at an end of said projecting part.

3. Bag according to claim 1, wherein said abutment portion of said arrangement is unitary with a band constituting an edge surrounding an opening of said bag.

4. Bag according to claim 1, wherein said arrangement is formed by a separate piece attached to an upper part of said bag.

5. Bag according to claim 1, wherein said molded piece has a recess formed in an exterior surface thereof for receiving said projecting part of said arrangement.

6. Bag according to claim 1, wherein the upper end part of said projecting part of said arrangement is notched.

7. Bag according to claim 1, wherein said movable projecting part of said arrangement includes a flat fastening hook connecting said upper end of said strap to said upper point of attachment.

8. Bag according to claim 7, wherein said flat fastening hook constitutes a spring snap hooked directly to said upper point of attachment.

9. Bag according to claim 7, wherein said flat fastening hook constitutes a spring snap hooked to an intermediate ring constituting said upper point of attachment.

10. Bag according to claim 9, wherein said flat fastening hook has a width sufficient to constitute a comfortable support for a forearm of a user.

11. Bag according to claim 10, wherein said width is between 3 and 4 cm.

12. Bag according to claim 1, wherein a stop is provided on an upper end of said abutment portion of said arrangement.

13. Bag according to claim 1 further comprising a handle made of a rigid plastic material and molded as a single piece with said abutment portion.

14. Elongated bag, especially for use with golf clubs, having a shoulder carrying strap including upper and lower ends, said ends being connected respectively to said bag at upper and lower points of attachment said elongated bag comprising an arrangement adapted for supporting a forearm of a user of said bag when said strap is in placed in a carrying position on a shoulder, said arrangement being located on said bag at a point above said upper point of attachment and comprising a substantially planar abutment portion unitary with a wall of said bag and a substantially planar part projecting substantially perpendicularly from said abutment portion, said abutment portion and said projecting part forming a support trough for a forearm of the user of said bag, wherein said projecting part is jointed, around a pin, on a molded piece fastened to said bag and having an upper end part, located above said hinge pin of said projecting part.

15. Bag according to claim 14, wherein said projecting part of said arrangement includes flat fastening hook connecting said upper end of said strap to said upper point of attachment.

16. Bag according to claim 15, wherein said flat fastening hook constitutes a spring snap hooked to an intermediate ring constituting said upper point of attachment (6) and being jointed to said molded piece (14).

17. Bag according to claim 15, wherein said flat fastening hook has a width sufficient to constitute a comfortable support for a forearm of a user greater.

18. Bag according to claim 17, wherein said width is between 3 and 4 cm.

* * * * *

UNITED STATES PATENT AND TRADEMARK OFFICE

CERTIFICATE OF CORRECTION

PATENT NO. : 5,221,030

DATED : June 22, 1993

INVENTOR(S) : Cretinon

It is certified that error appears in the above-indentified patent and that said Letters Patent is hereby corrected as shown below:

Column 5, claim 1, line 47, after "respectively" insert --,--;
line 51, change "bas" to --bag--;
line 54, change "bas" to --bag--.
Column 6, claim 15, line 53, after "includes" insert --a--.
Column 6, claim 17, line 63, after "user" delete "greater"--.

Signed and Sealed this

Twenty-sixth Day of April, 1994

*Attest:*

Bruce Lehman

BRUCE LEHMAN

*Attesting Officer*

*Commissioner of Patents and Trademarks*